US007571615B1

(12) United States Patent
Bikes

(10) Patent No.: US 7,571,615 B1
(45) Date of Patent: Aug. 11, 2009

(54) HELMET COOLING AND HEATING SYSTEM

(76) Inventor: Eduard Bikes, 11255 Marysville St., Spring Hill, FL (US) 34609

( * ) Notice: Subject to any disclaimer, the term of this patent is extended or adjusted under 35 U.S.C. 154(b) by 288 days.

(21) Appl. No.: 11/639,831

(22) Filed: Dec. 15, 2006

(51) Int. Cl.
*F25B 21/02* (2006.01)

(52) U.S. Cl. ..... 62/3.5; 62/3.3; 62/259.3

(58) Field of Classification Search ..... 62/3.5, 62/3.2, 3.3, 259.3
See application file for complete search history.

(56) References Cited

U.S. PATENT DOCUMENTS 4,893,356 A * 1/1990 Waters ..... 2/171.3

6,125,636 A * 10/2000 Taylor et al. ..... 62/3.5

* cited by examiner

*Primary Examiner*—Melvin Jones
(74) *Attorney, Agent, or Firm*—Edward P. Dutkiewicz

(57) ABSTRACT

A protective gear cooling device, comprising a helmet having an inside surface and an outside surface. There is a cooling plate coupled to the inside surface of the helmet. A pnp conductor and an npn conductor are coupled to the cooling plate. A heat sink is coupled to the conductors and to the outside surface of the helmet. A fan is coupled to the heat sink. A control module is electronically coupled to the fan and the conductors. Power is provided by a direct current power source. The source is electronically coupled to the control module.

19 Claims, 4 Drawing Sheets

FIG 1
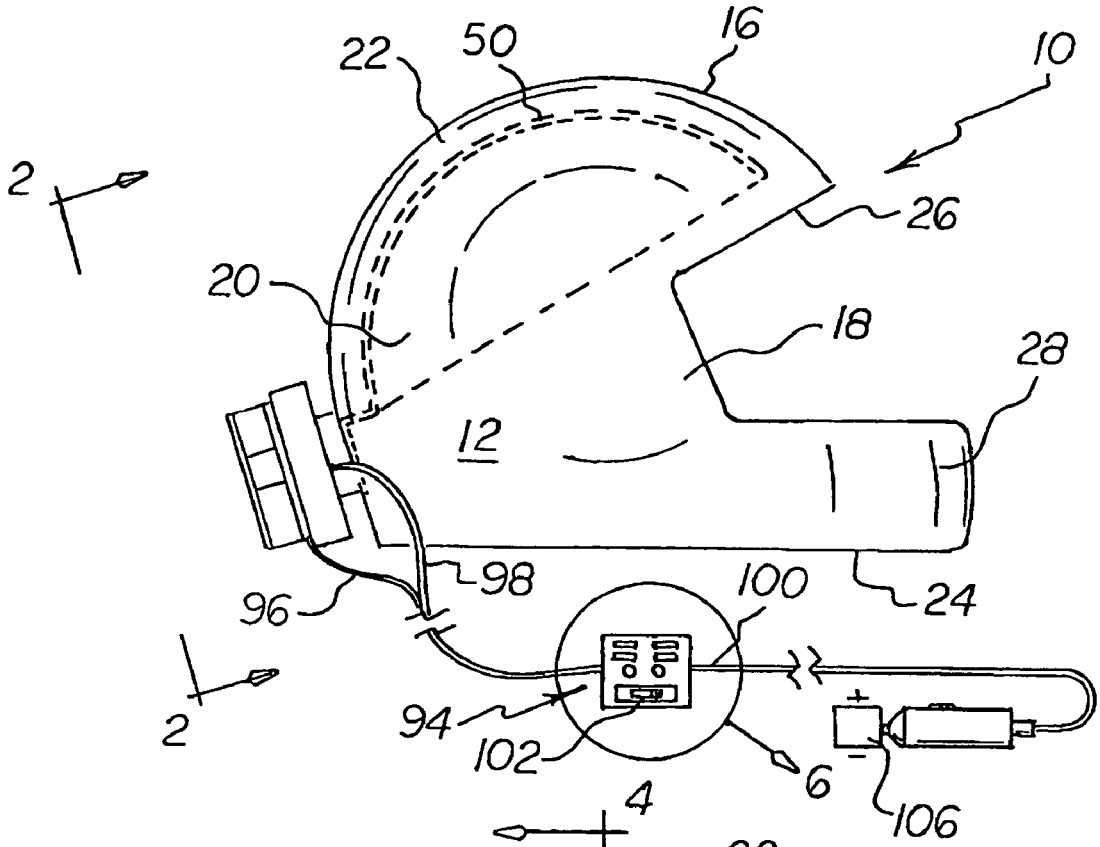
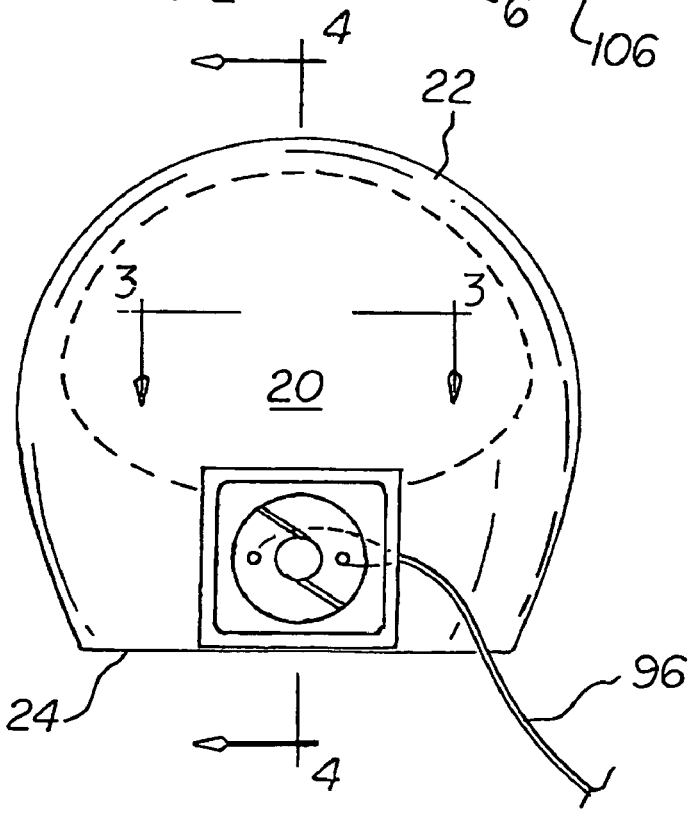
FIG 2

FIG 3
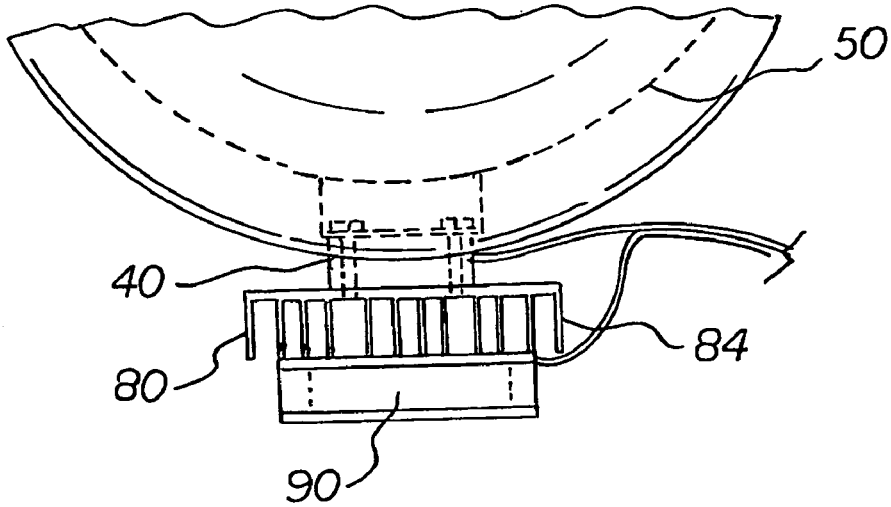
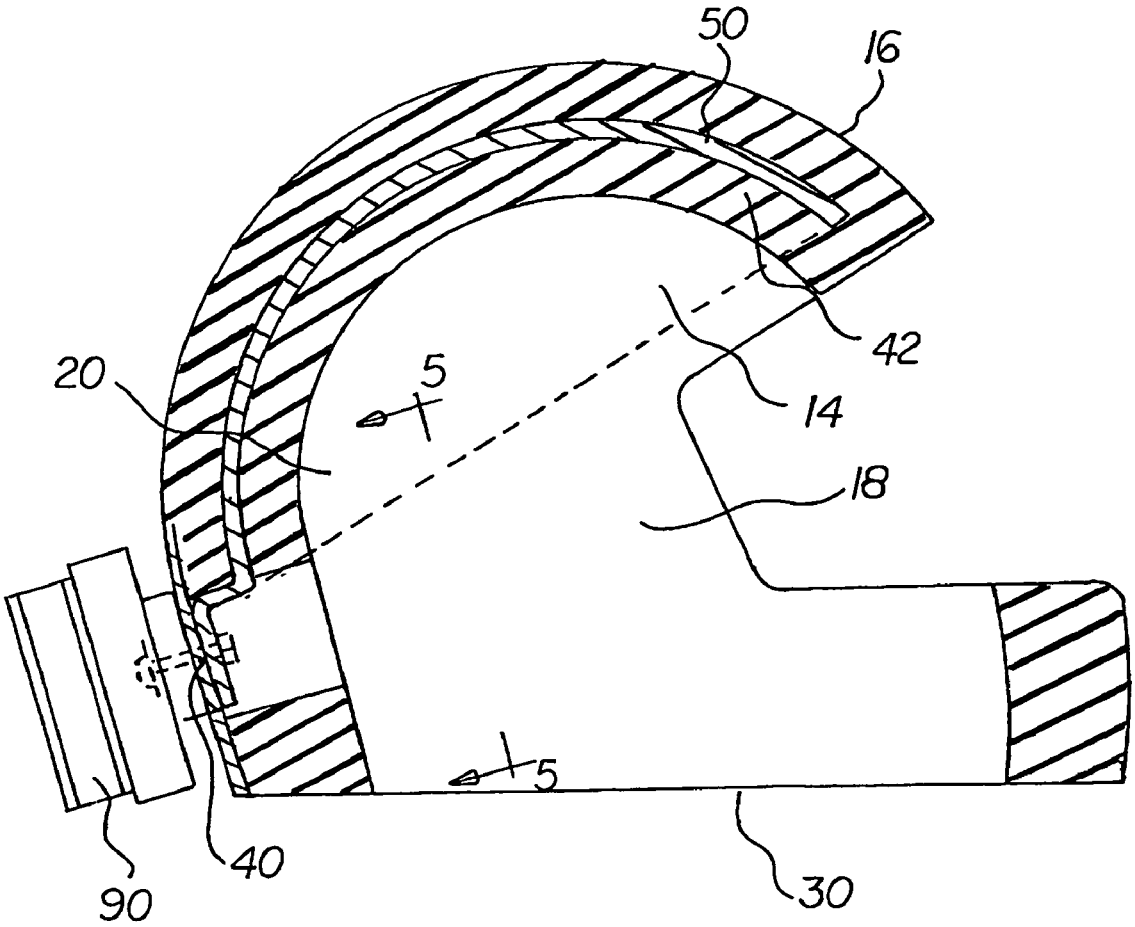
FIG 4

FIG 5
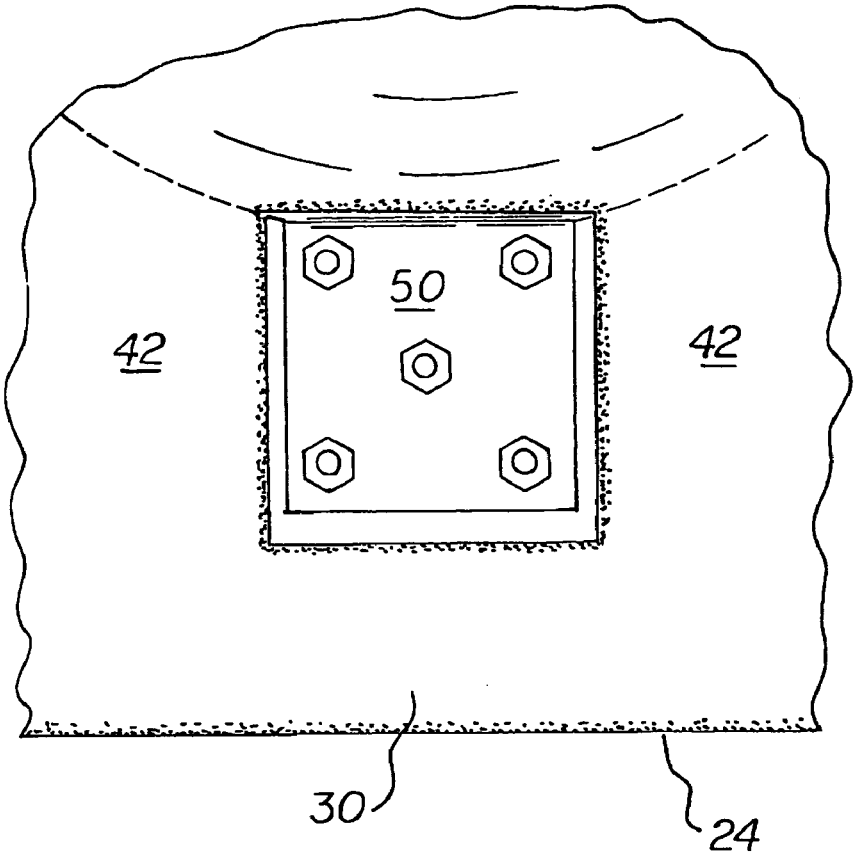
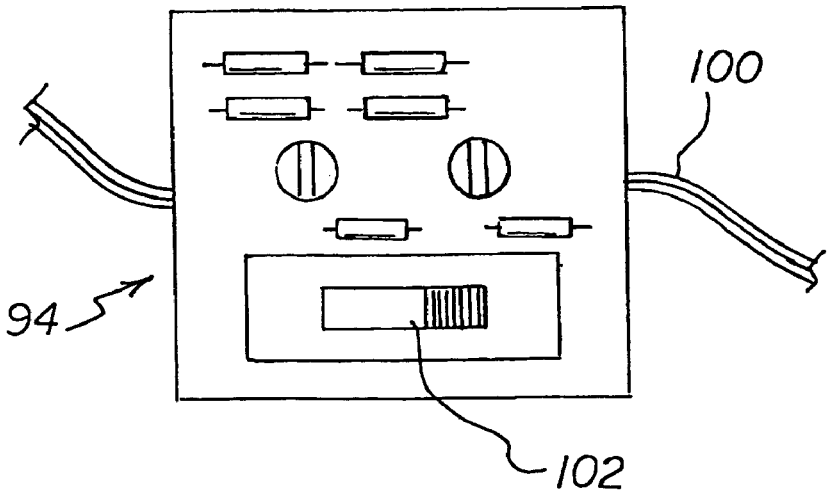
FIG 6

HELMET COOLING AND HEATING SYSTEM

BACKGROUND OF THE INVENTION

1. Field of the Invention

The present invention relates to a helmet cooling system and more particularly pertains to a system to cool the inside of a helmet during use.

2. Description of the Prior Art

The use of known devices and apparatuses to cool a helmet is known in the prior art. More specifically, known devices and apparatuses to cool a helmet previously devised and utilized for the purpose of cooling a helmet when in use are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 4,457,135 issued to Hakuraku et al. on Jul. 3, 1984 discloses a magnetic refrigerating apparatus. U.S. Pat. No. 4,509,334 issued to Nakagome et al. on Apr. 9, 1985 discloses a magnetic refrigerator. Lastly, U.S. Pat. No. 4,589,953 issued to Nakagome et al. on May 20, 1986 discloses a magnetic refrigerator.

While these devices fulfill their respective, particular objectives and requirements, the aforementioned patents do not describe helmet cooling system that allows a system to cool the inside of a helmet during use.

In this respect, the Helmet cooling system according to the present invention substantially departs from the conventional concepts and designs of the prior art, and in doing so provides an apparatus primarily developed for the purpose of a system to cool the inside of a helmet during use.

Therefore, it can be appreciated that there exists a continuing need for a new and improved helmet cooling system which can be used for a system to cool the inside of a helmet during use. In this regard, the present invention substantially fulfills this need.

SUMMARY OF THE INVENTION

In view of the foregoing disadvantages inherent in the known types of known devices and apparatuses to cool a helmet now present in the prior art, the present invention provides an improved Helmet cooling system. As such, the general purpose of the present invention, which will be described subsequently in greater detail, is to provide a new and improved Helmet cooling system and method which has all the advantages of the prior art and none of the disadvantages.

To attain this, the present invention essentially comprises a protective gear cooling device, comprising several components, in combination.

First provided is a helmet. The helmet is fabricated of a material having limited flexibility. The helmet has an inside surface and an outside surface with a thickness there between. The helmet has a forward face portion and a rearward occipital portion. The helmet has a top portion and a bottom neck portion. The forward face portion having a viewing aperture there through and a chin protection region. The bottom neck portion has an opening there through. The top portion is solid and continuous and the occipital portion has a mounting aperture there through.

There is next provided a cooling plate. The cooling plate is fabricated of a heat conductive material. The plate has a generally curved configuration. The cooling plate is located adjacent the inner surface of the helmet and coupled there to, between the inner surface of the helmet and the helmet liner.

Next provided is a pnp conductor and an npn conductor. Each of the conductors has a first end and a second end. The first ends of the conductors are electronically connected to each other. The first end of each conductor is thermally coupled to the cooling plate. The first end of each conductor has an associated electrical insulator so as to electronically insulate the first ends of the conductors from the cooling plate. The first ends of the conductors are coupled to the cooling plate through the occipital mounting aperture.

The second ends of the conductors are electronically isolated from each other.

Next provided is a heat sink. The heat sink is fabricated of a heat conductive material. The heat sink is thermally coupled to the second ends of each of the conductors. The heat sink has an associated electrical insulator so as to electronically insulate the heat sink from the second end of each of the conductors. The heat sink is coupled to the outer surface of the helmet.

Next provided is a fan. The fan is coupled to the heat sink and is located adjacent the heat sink. The fan is configured to move air across the heat sink.

Next provided is a control module. The control module is electronically coupled to the fan and the conductors. The control module has an associated pair of fan wires running to the fan. The control module has an associated pair of conductor wires running to the conductors. One of the pair of the conductor wires is electronically coupled to the second end of the npn conductor and the other of the pair of the conductor wires is electronically coupled to the second end of the pnp conductor. The control module has a power input comprising a positive electronic connection and a negative electronic connection. The control module has a polarity switching subassembly.

Lastly provided is a direct current power source. The direct current power source is electronically coupled to the control module.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved helmet cooling system which has all of the advantages of the prior art known devices and apparatuses to cool a helmet and none of the disadvantages.

It is another object of the present invention to provide a new and improved helmet cooling system which may be easily and efficiently manufactured and marketed.

It is further object of the present invention to provide a new and improved helmet cooling system which is of durable and reliable constructions.

An even further object of the present invention is to provide a new and improved helmet cooling system which is susceptible of a low cost of manufacture with regard to both materials and labor, and which accordingly is then susceptible of low prices of sale to the consuming public, thereby making such Helmet cooling system economically available to the buying public.

Even still another object of the present invention is to provide a helmet cooling system for a system to cool the inside of a helmet during use.

Lastly, it is an object of the present invention to provide a new and improved protective gear cooling device, comprising a helmet having an inside surface and an outside surface. There is a cooling plate coupled to the inside surface of the helmet. A pnp conductor and an npn conductor are coupled to the cooling plate. A heat sink is coupled to the conductors and to the outside surface of the helmet. A fan is coupled to the heat sink. A control module is electronically coupled to the fan and the conductors. Power is provided by a direct current power source. The source is electronically coupled to the control module.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is side elevational view of the system, demonstrating the relationship of the fan and heat sink.

FIG. 2 is a view taken along line 2-2 of FIG. 1.

FIG. 3 is a view taken along line 3-3 of FIG. 2.

FIG. 4 is a cross sectional view taken along line 4-4 of FIG. 2.

FIG. 5 is a view taken along line 5-5 of FIG. 4.

FIG. 6 is a close up view of the controller taken at circle 6 of FIG. 1.

The same reference numerals refer to the same parts throughout the various Figures.

DESCRIPTION OF THE PREFERRED EMBODIMENT

Figure 7:
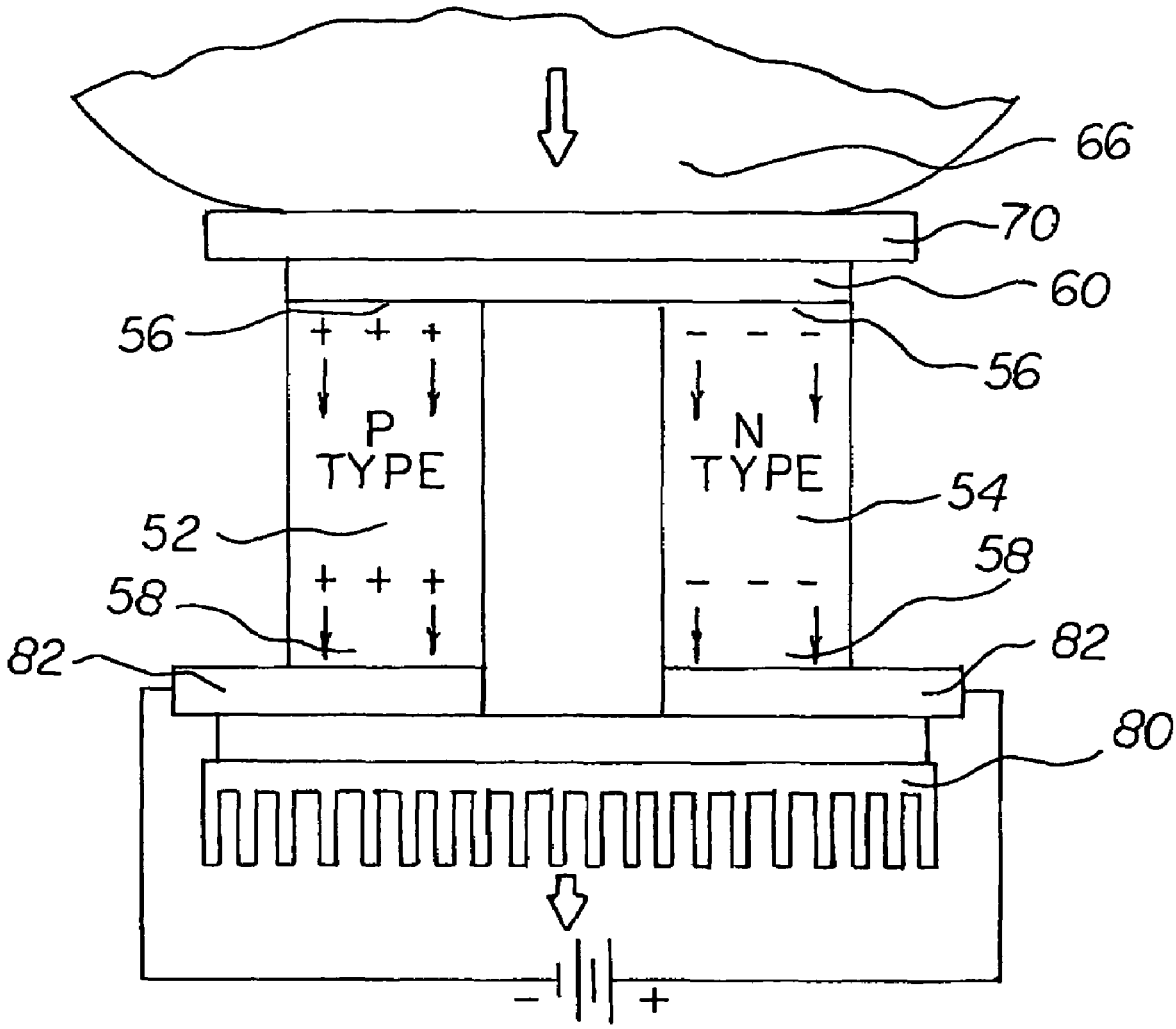
FIG. 7 is a depiction of the relationship of the conductors, the cooling plate, the heat sink and the power source, note the insulating of the conductors.

With reference now to the drawings, and in particular to FIG. 1 thereof, the preferred embodiment of the new and improved helmet cooling system embodying the principles and concepts of the present invention and generally designated by the reference numeral 10 will be described.

The present invention, the helmet cooling system 10 is comprised of a plurality of components. Such components in their broadest context include a helmet, a cooling plate, a heat sink and a controller. Such components are individually configured and correlated with respect to each other so as to attain the desired objective.

A protective gear cooling device, comprising several components, in combination.

First provided is a helmet 12. The helmet is fabricated of a material having limited flexibility. The material used is a member of a class of materials having limited flexibility that includes plastic, fiberglass, and carbon fiber composite.

In the preferred embodiment a composite material is used, but one skilled in the art would recognize that any material having limited flexibility could be used.

The helmet has an inside surface 14 and an outside surface 16 with a thickness there between. The helmet has a forward face portion 18 and a rearward occipital 20 portion. The helmet has a top portion 22 and a bottom neck portion 24. The forward face portion having a viewing aperture 26 there through and a chin protection region 28. The bottom neck portion has an opening there through 30.

The top portion of the helmet is solid and continuous. The occipital portion of the helmet has a mounting aperture 40 there through. In the preferred embodiment the helmet has an associated liner 42 located within the helmet surface and coupled to the helmet inner surface. One skilled in the art, however, would recognize that a helmet could be constructed without using a liner.

There is next provided a cooling plate 50. The cooling plate is fabricated of a heat conductive material. In the preferred embodiment the cooling plate is made of aluminum. The cooling plate has a generally curved configuration and is curved to conform to the inside surface of the helmet. The cooling plate is located adjacent the inside surface of the helmet and coupled there to, between the inside surface of the helmet and the helmet liner, if a liner is used.

In another embodiment, the cooling plate may be included within the helmet thickness (not shown). This would be accomplished by making the placement of the cooling plate part of the initial molding procedure for the helmet.

Next provided is a pnp conductor 52 and an npn 54 conductor. In the preferred embodiment the pnp and npn conductors are fabricated of bismuth telluride, which impedes conventional heat conduction, but provides for easy flow of carriers within the semiconductor. One skilled in the art would recognize that any semiconductor which impeded conventional heat conduction but allowed for easy flow of carriers could be used.

Each of the conductors has a first end 56 and a second end 58. The first ends of the conductors are electronically connected to each other 60. The first end of each conductor is thermally coupled 66 to the cooling plate. The first end of each conductor has an associated electrical insulator 70 so as to electronically insulate the first ends of the conductors from the cooling plate. The first ends of the conductors are coupled to the cooling plate through the occipital mounting aperture.

The second ends of the conductors are electronically isolated from each other.

Next provided is a heat sink 80. The heat sink is fabricated of a heat conductive material. In the preferred embodiment the heat sink is fabricated of aluminum, though one skilled in the art would recognize that any heat conductive material could be used.

The heat sink is thermally coupled to the second ends of each of the conductors. The heat sink has an associated electrical insulator 82 so as to electronically insulate the heat sink from the second end of each of the conductors. The heat sink is coupled to the outer surface of the helmet. In the preferred embodiment the heat sink is configured so as to have at least one cooling fin 84. One skilled in the art, however, would recognize that the heat sink may be fabricated with holes (not shown) there through or as a flat surface (not shown).

Next provided is a fan 90. The fan is coupled to the heat sink and is located adjacent the heat sink. The fan is configured to move air across the heat sink.

Next provided is a control module 94. The control module is electronically coupled to the fan and the conductors. The control module has an associated pair of fan wires 96 running to the fan. The control module has an associated pair of conductor wires 98 running to the conductors. One of the pair of the conductor wires is electronically coupled to the second end of the npn conductor and the other wire of the pair of the conductor wires is electronically coupled to the second end of the pnp conductor.

The control module has a power input 100 comprising a positive electronic connection and a negative electronic connection. The control module has a polarity switching subassembly 102. In this configuration the device may be used to cool the inside of the helmet, or to warm the inside of the helmet. By changing polarity of the control module, the device acts as a heater or a cooler.

Lastly provided is a direct current power source 106. The direct current power source is electronically coupled to the control module. In the preferred embodiment the power source is the electrical system of a motorcycle (not shown). In use the system would be plugged in, or otherwise connected, to the power source, or motorcycle electrical system.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A protective gear cooling device, comprising, in combination:

a helmet having an inside surface and an outside surface;

a cooling plate coupled to the inside surface of the helmet;

a pnp conductor and an npn conductor with each conductor having a first end and a second end, the conductors being coupled to the cooling plate;

a heat sink coupled to the outside surface of the helmet;

a fan coupled to the fin of the heat sink;

a control module being electronically coupled to the fan and the conductors;

the helmet being fabricated of a material having limited flexibility comprising an inner surface and an outer surface with a thickness there between, the helmet having a forward face portion and a rearward occipital portion and a top portion and a bottom neck portion, with the forward face portion having a viewing aperture there through and a chin protection region, the bottom neck portion having an opening there through, the top portion being solid and continuous and the occipital portion having a mounting aperture there through; and a direct current power source electronically coupled to the control module.

2. The protective gear cooling device as described in claim 1 wherein the helmet further comprises an associated liner located within the helmet surface and coupled to the helmet inner surface.

3. The protective gear cooling device as described in claim 2 wherein the helmet is fabricated of a composite material.

4. The protective gear cooling device as described in claim 1 wherein the cooling plate comprises a generally curved configuration, the cooling plate located adjacent the inner surface of the helmet.

5. The protective gear cooling device as described in claim 4 wherein the cooling plate is made of aluminum.

6. The protective gear cooling device as described in claim 5 wherein the helmet further comprises a helmet liner and the cooling plate is coupled between the inner surface of the helmet and the helmet liner.

7. The protective gear cooling device as described in claim 1 wherein the first ends of the conductors are electronically connected to each other and the second ends of the conductors are electronically isolated from each other.

8. The protective gear cooling device as described in claim 1 wherein the first end of each conductor is thermally coupled to the cooling plate and the first end of each conductor has an associated electrical insulator so as to electronically insulate the first ends of the conductors from the cooling plate.

9. The protective gear cooling device as described in claim 1 wherein the first ends of the conductors are coupled to the cooling plate through an occipital mounting aperture.

10. The protective gear cooling device as described in claim 1 wherein the heat sink is thermally coupled to the second ends of each of the conductors.

11. The protective gear cooling device as described in claim 10 wherein the heat sink has at least one cooling fin.

12. The protective gear cooling device as described in claim 1 wherein the heat sink is coupled to the second end of each of the conductors and the heat sink has an associated electrical insulator so as to electronically insulate the heat sink from the second end of each of the conductors and to electronically insulate the second end of the pnp conductor from the second end of the npn conductor.

13. The protective gear cooling device as described in claim 12 wherein the heat sink is made of aluminum.

14. The protective gear cooling device as described in claim 1 wherein the fan is located adjacent the fin of the heat sink, the fan being configured to move air across the fin of the heat sink.

15. The protective gear cooling device as described in claim 1 wherein the control module further comprises an associated pair of conductor wires running to the conductors.

16. The protective gear cooling device as described in claim 15 wherein one of the pair of the conductor wires is electronically coupled to the second end of the npn conductor and the other of the pair of the conductor wires is electronically coupled to the second end of the pnp conductor.

17. The protective gear cooling device as described in claim 1 wherein the control module further comprises an associated pair of fan wires running to the fan, the control module having a power input comprising a positive electronic connection and a negative electronic connection.

18. The protective gear cooling device as described in claim 17 wherein the control module further comprises a polarity switching subassembly.

19. A protective gear cooling device, comprising, in combination:

a helmet fabricated of a plastic, the helmet having an inner surface and an outer surface with a thickness there between, the helmet having a forward face portion and a rearward occipital portion and a top portion and a bottom neck portion, with the forward face portion having a viewing aperture there through and a chin protection region, the bottom neck portion having an opening there through, the top portion being solid and continuous and the occipital portion having a mounting aperture there through, the helmet having an associated liner located within the helmet surface and coupled to the helmet inner surface;

a cooling plate, fabricated of aluminum, the plate having a generally curved configuration, the cooling plate located adjacent the inner surface of the helmet and coupled there to between the inner surface of the helmet and the helmet liner;

a pnp conductor and an npn conductor with each conductor having a first end and a second end, with the first ends of the conductors being electronically connected to each other, the first end of each conductor being thermally coupled to the cooling plate and the first end of each conductor having an associated electrical insulator so as to electronically insulate the first ends of the conductors from the cooling plate, the second ends of the conductors being electronically isolated from each other, the first ends of the conductors being coupled to the cooling plate through the occipital mounting aperture;

a heat sink fabricated of aluminum, the heat sink having a configuration having a height and a width and a length, the heat sink having at least one cooling fin, with the heat sink being thermally coupled to the second ends of each of the conductors, the heat sink having an associated electrical insulator so as to electronically insulate the heat sink from the second end of each of the conductors, the heat sink being coupled to the outer surface of the helmet;

a fan coupled to the fin of the heat sink and located adjacent the fin of the heat sink, the fan being configured to move air across the fin of the heat sink;

a control module being electronically coupled to the fan and the conductors, the control module having an associated pair of fan wires running to the fan and an associated pair of conductor wires running to the conductors, with one of the pair of the conductor wires being electronically coupled to the second end of the npn conductor and the other of the pair of the conductor wires being electronically coupled to the second end of the pnp conductor, the control module having a power input comprising a positive electronic connection and a negative electronic connection, the control module having a polarity switching subassembly; and, a direct current power source electronically coupled to the control module.

* * * * *